United States Patent [19]

Panicci

[11] 4,116,202

[45] Sep. 26, 1978

[54] TEETHER WITH PRESSURIZED FLUID

[75] Inventor: Richard L. Panicci, Hanover, Mass.

[73] Assignee: Kiddie Products, Inc., Avon, Mass.

[21] Appl. No.: 809,108

[22] Filed: Jun. 22, 1977

[51] Int. Cl.[2] ..... A61J 17/00

[52] U.S. Cl. ..... 128/359

[58] Field of Search ..... 128/359, 360, 136, 62 A; D83/8 C; D24/45

[56] References Cited

U.S. PATENT DOCUMENTS

| | | | |
|---|---|---|---|
| D. 176,877 | 2/1956 | Newmark | D24/45 |
| 2,703,087 | 3/1955 | Newmark | 128/359 |
| 2,766,757 | 10/1956 | Zelony | 128/359 |
| 3,669,117 | 6/1972 | Herbst | 128/360 |
| 3,825,014 | 7/1974 | Wroten | 128/360 |
| 3,923,067 | 12/1975 | Hurst | 128/360 |
| 3,924,621 | 12/1975 | Cassimally | 128/252 |
| 3,990,455 | 11/1976 | Panicci | 128/359 |

*Primary Examiner*—Lawrence W. Trapp

[57] ABSTRACT

A teether comprising separate sheets of plastic material sealed together along their edges, said sheets defining separate cells connected by narrow necks, said teether having fluid under pressure in the cells, the necks defining fluid flow paths between the cells; at least one seal set inwardly from the edge seals joins the opposite sheets together at the necks to define multiple flow paths at the necks limiting outward deformation of the plastic at the necks while maintaning a substantial cross-sectional area for fluid communication between cells.

5 Claims, 4 Drawing Figures

FIG 1
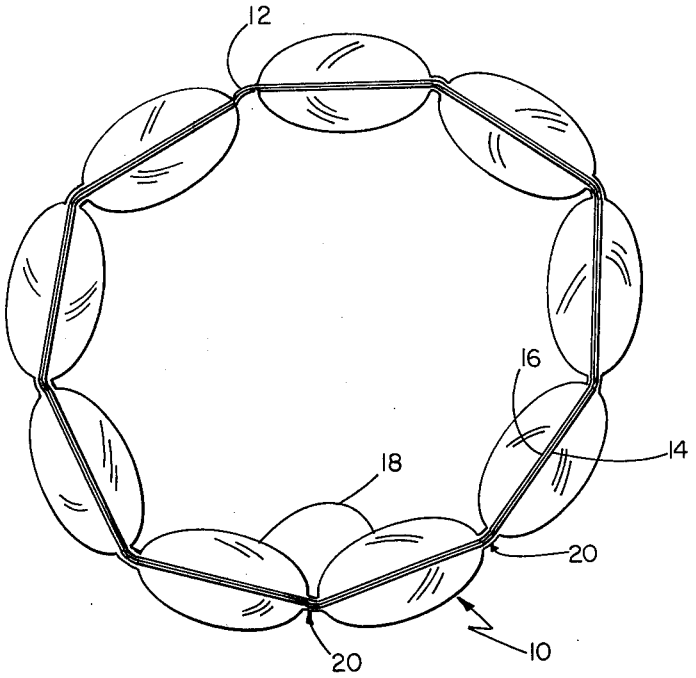
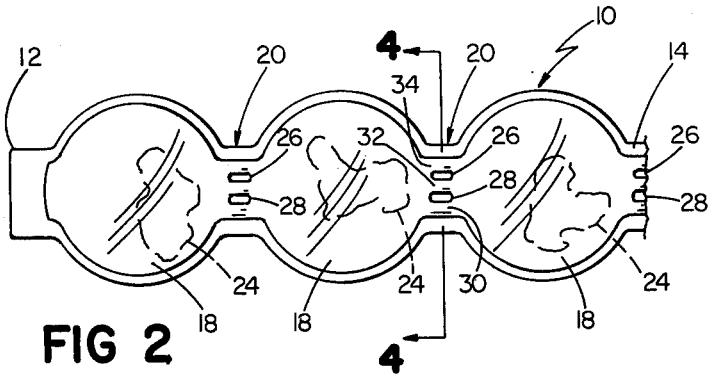
FIG 2
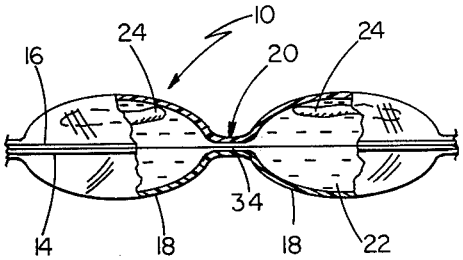
FIG 3
FIG 4
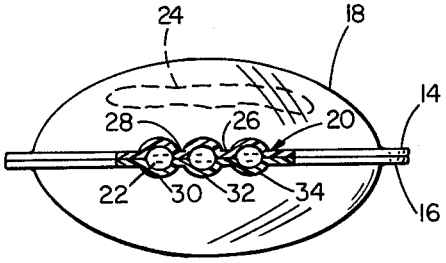

TEETHER WITH PRESSURIZED FLUID

This invention relates to teethers and more particularly to teethers containing fluid under pressure.

Such teethers typically are made from sheet polyvinyl chloride, cut to form enlarged cells connected by narrow necks. Two sheets are placed together, optionally with decorative objects therebetween at the location of the cells and are sealed along their edges. Fluid, e.g., water, is then injected under pressure into the tube, passing through the fluid flow paths defined by the necks and inflating the cells. The fluid flow paths between cells thus facilitate a simple filling procedure and also activate the decorative objects when the filled tube is squeezed forcing fluid between the cells. The ends of the tube are then sealed and formed in a ring. When formed in a ring, bending of the teether occurs at the narrow necks. The stresses imposed on the material at the necks, which are inflated out of the plane of the sheet material, sometimes result in rupture of the tube at the necks with consequent leakage of fluid from and collapse of the tube.

It is accordingly a principal object of this invention to provide a teether having a construction which reduces the bending stresses at the necks between cells, minimizing the risk of rupture, and which maintains an adequate cross-sectional ara of the flow paths between the cells.

In general, the invention features a teether comprising separate sheets of organic thermoplastic material sealed together along their edges defining a plurality of separate cells interconnected by narrow necks between the cells. The teether contains a fluid underpressure, fluid flow paths defined by the necks communicating the fluid between adjacent cells. The sheets are connected together at the necks by at least one seal spaced inwardly from the edges thus defining multiple flow paths at the necks.

In preferred embodiments a plurality of flow path defining seals are provided at each neck and the height of the flow paths is no greater than five times the material thickness of the sheets, preferably being about three times the material thickness.

Other objects, features and advantages of this invention will be apparent to those skilled in the art from the following detailed description of a preferred embodiment taken together with the accompanying drawings, in which:

FIG. 1 is a plan view of a teether embodying the invention;

FIG. 2 is a fragmentary enlarged side elevation of a portion of the teether of FIG. 1 prior to formation into a ring;

FIG. 3 is a fragmentary plan view, partially broken away, of the teether portion of FIG. 2; and FIG. 4 is an enlarged sectional view taken along the line 4—4 of FIG. 2.

The teether 10 as illustrated in FIG. 1 is formed into a ring by sealing the ends 12 together. As best shown in FIGS. 3 and 4, the teether is formed of two separate sheets 14,16 of organic thermoplastic material such as polyvinyl chloride which are sealed together along their edges. Sealing is normally accomplished by a dielectric sealing process. As shown in FIG. 2, the sheets 14,16 are cut to form enlarged cells 18 interconnected by narrow necks 20. The teether is filled with liquid 22 underpressure and the necks define fluid flow paths between adjacent cells 18. Optionally, decorative objects 24 are placed between sheets 14,16 at the positions of the cells 18 before the edges are sealed.

At each neck 20, spaced inwardly from the sealed edges of sheets 14,16, a pair of seals 26,28 are provided to reduce the maximum height of the passages or flow paths 30,32,34 from the plane of sheets 14,16. The interior height of the passages does not exceed five times the thickness of the material from which sheets 14,16 are formed and preferably is about three times the material thickness. Thus, with sheet material having a thickness of 0.012 inches, the interior height of passages 30,32,34 is preferably about 0.036 inches.

Advantageously, the reduced height of the passages 30,32,34 relative to the plane of the sheet material minimizes the stresses imposed on the material when the necks are bent, reducing the likelihood of rupture and fluid leakage. The provision of multiple passages, however, preserves a substantial cross-sectional area of the flow paths between cells, facilitating filling of the tube and preserving the action of the decorative objects when the tube is squeezed.

Other embodiments of this invention will occur to those skilled in the art which are within the scope of the following claims.

What is claimed is:

1. A teether comprising two separate sheets of organic thermoplastic material sealed together along their edges and defining a plurality of separate cells connected together by narrow necks between said cells, fluid underpressure within said cells, and fluid flow paths defined by said necks communicating said fluid between adjacent cells, the improvement in which said sheets are connected together at said necks by at least one seal between and spaced inwardly from said edges to define multiple fluid flow paths at each said necks.

2. The improvement claimed in claim 1 in which said sheets are connected together at each said neck by a plurality of seals spaced apart from each other and spaced inwardly from said edges.

3. The improvement claimed in claim 1 in which the maximum height of said fluid flow paths between said sheets is no greater than five times the material thickness of said sheets.

4. The improvement claimed in claim 3 in which said maximum height is about three times said material thickness.

5. The improvement claimed in claim 4 in which said sheets are connected together at each said neck by a plurality of seals spaced apart from each other and spaced inwardly from said edges.

* * * * *